United States Patent [19]

Brinkmann et al.

[11] 3,987,224

[45] Oct. 19, 1976

[54] OXYGEN CONTROL IN CONTINUOUS METAL CASTING SYSTEM

[75] Inventors: Joseph Bernard Brinkmann, Oxford, Conn.; Ralph Edgar Carter; Malcolm Robert Knapp, both of Schenectady, N.Y.

[73] Assignee: General Electric Company, New York, N.Y.

[22] Filed: June 2, 1975

[21] Appl. No.: 582,669

[52] U.S. Cl. ..... 427/432; 75/76; 164/56

[51] Int. Cl.[2] ..... C22B 15/14; B22D 27/18

[58] Field of Search ..... 164/56, 86, 66; 75/76; 427/432

[56] References Cited

UNITED STATES PATENTS

| | | | |
|---|---|---|---|
| 2,989,397 | 6/1961 | Kuzell et al. | 75/76 |
| 3,298,070 | 1/1967 | Yurko et al. | 75/76 X |
| 3,484,280 | 12/1969 | Carreker | 75/76 X |
| 3,528,803 | 9/1970 | Ichikawa | 164/56 X |

*Primary Examiner*—Travis S. McGehee

*Attorney, Agent, or Firm*—R. G. Simkins; P. L. Schlamp; F. L. Neuhauser

[57] ABSTRACT

Method of regulating and reducing the oxygen content of a molten copper-containing metal supply for a continuous metal casting process which comprises passing a metal core member through a body of molten metal and thereby accreting and solidifying molten metal on the core member. The method comprises the application of a mixture of gases comprising hydrogen and nitrogen to the molten metal supply to reduce the oxygen contents thereof.

12 Claims, No Drawings

OXYGEN CONTROL IN CONTINUOUS METAL CASTING SYSTEM

BACKGROUND OF THE INVENTION

This invention relates to an improvement in a process for continuous casting of copper-containing metal, or the so-called "dip-forming process" of metal casting. The dip-forming system for the continuous casting of copper-containing metal comprises supplying a body of molten copper-containing metal and passing a metal core member through the molten metal and thereby accreting and solidifying molten metal on the core member.

The dip-forming process of continuous metal casting is primarily practiced with copper or copper-containing alloys for the production of copper or copper alloy rod stock for use in the manufacture of electrical conductors and wires, including enameled magnet wire for electrical apparatus, such as the enameled wire disclosed in U.S. Pat. No. 3,161,541.

The harmful effects of a high oxygen content in either the core member or in the melt upon the casting operation and cast products thereof are well known and documented in the art of continuous dip-form casting of copper-containing metals, for example note U.S. Pat. Nos. 3,484,280; 3,060,053; 3,060,056 and 3,008,201, and U.S. Pat. No. 3,490,897 and the prior art cited therein. For instance, the presence of a high oxygen content, such as approximately 20 or more parts per million by weight of the copper-containing metal, interferes with the rapid and even heat exchange between the core member and the melt solidifying thereon which reduces the uniformity and strength of the bond between the core member and the molten metal accreted thereon. The presence of such high oxygen contents and its effects additionally produce an irregular cast body or layer and configuration. Also, a high oxygen content in the melt causes irregularities and imperfections within the mass and on the surface of the cast body of solidified melt accreted over the core member, and produces undesirable oxides, among other detractions. Moreover, these adverse consequences of a high oxygen content can progressively deteriorate the casting operation and the cast products thereof because their effects are cumulative if the core member is repeatedly recycled through the system and recast and redrawn, as is often the case. Entrained imperfections within the mass of a cast layer or impediments intermediate the cast layer and the underlying metal adversely influence the drawing or reduction rolling of the cast product into units of smaller cross-sectional dimensions and the products derived therefrom such as wire.

A high oxygen content in the dip-forming system or melt, or the copper or copper alloy rod product can result from any one or combinations of several sources including, for example, the presence of oxygen source ingredients in the supply of the copper or alloy melt, the decomposition of water or hydrocarbon contaminants entrained within the melt, or simply oxygen gas absorbed from the atmosphere of the system.

SUMMARY OF THE INVENTION

This invention includes a novel method for carrying out a continuous metal casting or dip-forming process comprising passing a core member through a body of molten metal, which effectively reduces and controls the oxygen content of the molten metal and thereby overcomes the difficulties previously encountered with this system of casting copper-containing metals and the products formed therefrom due to excessive oxygen concentration.

The method of this invention specifically comprises passing a mixture of gases comprising hydrogen and nitrogen through the molten metal to be cast upon the core member by accretion and solidification thereon, whereby the oxygen content of the melt is significantly reduced to levels which are not detrimental, and without the introduction of any ancillary degrading effects.

OBJECTS OF THE INVENTION

A primary object of this invention is to provide a method of continuously casting metal which produces a cast product of greater uniformity and purity.

Another object of this invention is to control and reduce the amount of oxygen contained in the casting system or melt of a continuous casting process wherein a metal core member is passed through molten metal to accrete and solidify the molten metal thereon, and the cast products thereof.

A further object of this invention is to continuously cast copper or an alloy of copper continuously by passing a copper or copper alloy core through a body of molten copper or an alloy thereof, and in a manner effective to produce a cast copper product having more uniform and improved physical properties and chemical composition.

An additional object of this invention is to produce low oxygen-containing cast copper or copper alloys and cast rod products thereof which are amenable to drawing or reduction rolling to small diameter electrical conductors and wire of high quality, and copper products requiring oxygen-free copper characteristics, without incurring any impeding properties or elements.

A specific object of this invention is to produce cast products of copper-containing metal which meet or surpass the industry standard of "Oxygen-Free" of less than 4 parts per million of oxygen, and which pass A.S.T.M. – B170.

DETAILED DESCRIPTION OF A PREFERRED EMBODIMENT

In a typical dip-forming continuous casting system, such as shown in U.S. Pat. No. 3,484,280, a metal, for example copper or a copper alloy, is melted in a suitable furnace and the melt is supplied to a crucible or refractory chamber for casting. A rod-like core member is continuously passed through the molten metal contents of the crucible or chamber, such as by continuously passing the core member upwardly through the crucible and its molten contents, whereby the molten metal accretes and solidifies on the core member.

According to this invention, the molten metal, preferably in the melting furnace or prior to the casting operation so as to provide for the effectuation of the oxygen removal, is subjected to a mixture of gases comprising nitrogen and hydrogen which causes the removal and reduction of oxygen therefrom. In order to afford optimum effectiveness, the system should provide for adequate distribution of the gas mixture through the melt and with extensive contact therebetween. The mixture of gases is applied to the melt by sparging or bubbling the gas within and through the molten metal. The sparging or bubbling can be effectively accomplished by introducing the gaseous mixture into the melt through suitable ports in lower portions of the melting furnace such as lower areas of the walls or the bottom thereof, or simply inserting a suitable feed means such as a tube or conduit into the melt.

The quantities of the hydrogen-nitrogen containing gas mixture applied and passed through the melt depend, of course, upon the initial oxygen contents of the melt and the effectiveness of the gas distribution means of the particular system. However, the gas mixture should comprise at least about 0.15 cubic foot of hydrogen per 100 pounds of copper or copper alloy processed, to reduce an oxygen concentration of about 20 parts per million typically occurring in the copper melt to about 10 parts per million. Preferably greater volumes of about 0.25 cubic foot of hydrogen per 100 pounds of melt is used to expedite the reduction and/or further reduce the oxygen content of the melt. These quantities are in substantial excesses of precise stoichiometric proportions for such an oxygen content so as to achieve an effective reactive exposure of the hydrogen to the oxygen dispersed within the relatively viscous medium of a molten metal.

In all instances throughout the disclosure of this application and the appended claims, the volumes of gas specified are in standard cubic feet or other stated volumetric units consisting of the quantity of gas determined at 0° C temperature and 1 atmospheric pressure.

In addition to the aforesaid specified quantities of hydrogen, the gas administered in the practice of this invention must consist of a major portion of nitrogen as an "inert" dilutent, such as at least about 85 percent by volume and preferably about 95 percent by volume, admixed with the required portions of hydrogen. The application of a mixture of gases containing a predominant portion of nitrogen has been found effective to obviate any build up of a hydrogen gas concentration within the melt. Thus, this invention provides for the removal of oxygen and control of its concentration within the melt without introducing any adverse or degrading side effects or elements, and in particular without discernibly increasing the hydrogen concentration of the melt.

Furthermore, there may be situations when the only economically practical source of a large volume of such a gas mixture adequate for the commercial practice of this invention comprises the incomplete combustion products of natural or produced hydrocarbon fuel gas burned with an insufficient supply of air which has been gauged to form an admixture composed predominately of nitrogen with minor quantities of hydrogen and carbon monoxide which is virtually free of oxygen. The carbon monoxide content in such combustion gases is, of course, an oxygen reducing agent, but experimental work has indicated that hydrogen is much more effective than carbon monoxide for reducing the oxygen content in a copper melt. Thus, the presence of minor quantities of carbon monoxide can as a practical matter be discounted as a component not having any significant effect upon the performance of the invention.

Nevertheless, a typical combustion product gas mixture for use in the practice of this invention comprises about 85 to about 95 percent by volume of nitrogen, and at least about 3 to about 10 percent by volume of hydrogen, with the balance of up to about 10 percent by volume of carbon monoxide, and of course minor trace amounts of other gaseous and suspended solid materials.

To produce effectively a cast copper stock of satisfactory quality for use in drawing or reducing in the manufacture of small diameter product such as wire and conductors, the oxygen content of the cast metal should be below about 10 parts per million and preferably below about 4.0 parts per million, with a content of approximately 2.0 parts of oxygen per million parts of melt being highly satisfactory for such service.

A specific demonstration illustrating measures for carrying out this invention and the improved effects produced thereby is provided by the following test performed with a routine continuous casting factory production operation and apparatus for the manufacture of cast copper rod stock. The dip-forming continuous casting production system utilized in this evaluation had a calculated nominal furnace through-put rate of about 5 tons of copper per hour. The mixture of gases comprising approximately 90 percent nitrogen by volume, 5 percent hydrogen by volume and 5 percent carbon monoxide by volume was applied thereto as described at a rate of 20 cubic feet per minute (0° C $\xi$ 1 atm) for an application of about one cubic foot of hydrogen per 167 pounds of melt. The mixture of gases was administered to the molten copper through a graphite pipe with a one-half inch inside diameter and provided with forty-two 1/16 inch holes in six equally spaced rings between two and six inches from the closed end thereof, by immersion of the pipe into the melt and dispersal of the gas from the pipe through the melt.

Prior routine production experience and testing with the same factory production apparatus and system operating under normal conditions and with the same source of copper stock for the melt as in the following demonstration, has established that the oxygen content of the melt during routine production averages about 9 parts of oxygen per million of melt.

The test demonstrating the effectiveness of this invention was started shortly after the beginning of a new production run. That is, the furnace and heating components of the system were idled for approximately 36 hours during which time the system was equalized whereupon measurement of the oxygen content of the copper melt was commenced and determined to be about 2 parts per million by weight. This low oxygen content of about 2 parts per million by weight did not change significantly when the continuous dip-form casting operation was initiated approximately 200 minutes thereafter by continuously moving the core or seed rod through the melt, although analysis of this factory production system showed that the oxygen content of the melt will increase to a routine volume of about 9 parts per million following the onset of dip-form casting.

At approximately 290 minutes from start, or about 90 minutes after commencing casting, the sparging of the melt was initiated by bubbling the described mixture of gases through the molten copper under the condition and rate set forth above. Numerous oxygen concentration determinations were repeatedly made during the test run by sampling the copper melt and ascertaining the oxygen content of the samples by means of a vacuum fusion analytical test. These tests consistently established the oxygen content of the melt to have been about 2 parts per million or less throughout the term of the sparging with the mixture of gas comprising nitrogen and hydrogen rather than increasing to the prior routine level of about 9 parts per million.

The foregoing application of this invention resulted in the oxygen concentration of the melt being effectively held at a level of about 2 parts per million of the melt or less throughout the testing operation rather than increasing to and remaining at a level of about 9 parts per million as had been heretofore normal.

Although the invention has been described with reference to certain specific embodiments thereof, numerous modifications are possible and it is desired to cover all modifications falling within the spirit and scope of the invention.

What we claim as new and desire to secure by Letters Patent of the United States is:

1. A method of continuously casting copper, comprising the steps of:

a. melting copper metal;

b. bubbling a mixture of gases consisting of nitrogen and about 3 to about 10 percent by volume of hydrogen through the resultant molten copper to reduce the oxygen content thereof; and c. passing a copper core member through the molten copper with reduced oxygen content, and thereby accreting and solidifying the molten copper with a reduced oxygen content on the core member.

2. The method of claim 1, wherein the mixture of gases is bubbled through the molten copper at a rate providing at least about 0.25 cubic foot of hydrogen gas per 100 pounds of the copper melt.

3. The method of claim 1, wherein the mixture of gases is bubbled through the molten copper at a rate of approximately 6 to approximately 36 cubic feet per 100 pounds of the copper melt.

4. The method of claim 3, wherein the oxygen content of copper melt is reduced below about 5.0 parts per million by weight.

5. A method of continuously casting copper metal, comprising the steps of:

a. melting copper metal;

b. bubbling a mixture of gases consisting of nitrogen and about 3 to about 10 percent by volume of hydrogen through the resultant molten copper at a rate providing at least about 0.15 cubic foot of hydrogen gas per 100 pounds of the copper melt to reduce the oxygen content of the copper melt below about 10.0 parts per million by weight; and c. passing a copper core member through the molten copper having an oxygen content below about 10.0 parts per million, and thereby accreting and solidifying the molten copper with a reduced oxygen content on the core member.

6. The method of claim 5, wherein the mixture of gas is bubbled through the molten copper at a rate providing about 0.25 cubic foot of hydrogen gas per 100 pounds of the copper melt and thereby reducing the oxygen content of the copper melt to below approximately 5.0 parts per million.

7. A method of continuously casting copper, comprising the steps of:

a. melting copper metal;

b. bubbling a mixture of gases consisting of about 90 to about 97 percent by volume of nitrogen and about 3 to about 10 percent by volume of hydrogen through the molten copper to reduce the oxygen content thereof; and c. passing a copper core member through the molten copper with reduced oxygen content, and thereby accreting and solidifying the molten copper with a reduced oxygen content on the core member.

8. The method of claim 7, wherein the mixture of gases is bubbled through the molten copper at a rate providing at least about 0.25 cubic foot of hydrogen per 100 pounds of the melt.

9. A method of continuously casting copper, comprising the steps of:

a. melting copper metal;

b. bubbling a mixture of gases consisting of about 90 to about 97 percent by volume of nitrogen and about 3 to about 10 percent by volume of hydrogen through the resultant molten copper at a rate of at least about 3 cubic feet per 100 pounds of the copper melt to reduce the oxygen content thereof; and c. passing a copper core member through the molten copper with reduced oxygen content, and thereby accreting and solidifying the molten copper with a reduced oxygen content on the core member.

10. The method of claim 9, wherein the mixture of gases is bubbled through the molten copper at a rate of about 6 to about 36 cubic feet per 100 pounds of melt.

11. The method of claim 10, wherein the mixture of gases is bubbled through the molten copper at a rate providing at least about 0.25 cubic foot of hydrogen per 100 pounds of melt.

12. A method of continuously casting copper, comprising the steps of:

a. melting copper metal;

b. bubbling a mixture of gases consisting of about 90 to about 97 percent by volume of nitrogen with about 3 to about 10 percent by volume of hydrogen through the resultant molten copper at a rate of about 6 to about 36 cubic feet of said gas mixture per 100 pounds of the copper melt to reduce the oxygen content thereof; and c. passing a copper core member through the molten copper with reduced oxygen content, and thereby accreting and solidifying the molten copper with a reduced oxygen content on the core member.

* * * * *